US009306262B2

(12) United States Patent
Puzella et al.

(10) Patent No.: US 9,306,262 B2
(45) Date of Patent: Apr. 5, 2016

(54) STACKED BOWTIE RADIATOR WITH INTEGRATED BALUN

(71) Applicant: Raytheon Company, Waltham, MA (US)

(72) Inventors: Angelo M. Puzella, Marlborough, MA (US); Kenneth S. Komisarek, Manchester, NH (US); James A. Robbins, Merrimac, MA (US)

(73) Assignee: Raytheon Company, Waltham, MA (US)

( * ) Notice: Subject to any disclaimer, the term of this patent is extended or adjusted under 35 U.S.C. 154(b) by 617 days.

(21) Appl. No.: 13/956,875

(22) Filed: Aug. 1, 2013

(65) Prior Publication Data

US 2014/0218253 A1 Aug. 7, 2014

Related U.S. Application Data

(63) Continuation-in-part of application No. 12/791,150, filed on Jun. 1, 2010, now Pat. No. 8,581,801.

(51) Int. Cl.
*H01Q 1/12* (2006.01)
*H01P 5/10* (2006.01)
(Continued)

(52) U.S. Cl.
CPC .. *H01P 5/10* (2013.01); *H01Q 9/28* (2013.01); *H01Q 21/062* (2013.01); *H01Q 21/26* (2013.01); *Y10T 29/49018* (2015.01)

(58) Field of Classification Search
CPC ..... H01Q 21/062; H01Q 21/26; H01Q 9/16; H01Q 9/28
USPC ..... 343/700 MS, 795, 797, 798, 878, 890, 343/898
See application file for complete search history.

(56) References Cited

U.S. PATENT DOCUMENTS 2,935,747 A 5/1960 Ghose
3,987,456 A * 10/1976 Gelin ..... H01Q 1/38 343/773

(Continued)

FOREIGN PATENT DOCUMENTS

EP 1 041 671 A1 10/2000
GB 2 316 233 A 2/1998

(Continued)

OTHER PUBLICATIONS

Bayard et al.; "Analysis of Infinite Arrays of Printed Dipoles on Dielectric Sheets Perpendicular to a Ground Plane;" IEEE Transactions on Antennas and Propagation, vol. 39, No. 12; Dec. 1991; 11 Pages.

(Continued)

*Primary Examiner* — Tho G Phan
(74) *Attorney, Agent, or Firm* — Daly, Crowley, Mofford & Durkee, LLP

(57) ABSTRACT

A turnstile antenna element and balun for use in a phased array are described. The antenna includes a plurality of stacked bowtie radiators. Each stacked bowtie radiator includes a driven conductor and a passive conductor separated by a dielectric. The balun includes a central member having dielectric slabs symmetrically disposed on external surfaces thereof. At least one end of the balun is provided having a shape such that conductors on the dielectric slabs of the balun can be coupled to the driven radiator conductors.

16 Claims, 12 Drawing Sheets

(51) Int. Cl.

| | |
|---|---|
| ***H01Q 9/28*** | (2006.01) |
| ***H01Q 21/06*** | (2006.01) |
| ***H01Q 21/26*** | (2006.01) |

(56) References Cited

U.S. PATENT DOCUMENTS

| | | | | |
|---|---|---|---|---|
| 4,668,956 | A | 5/1987 | Mahnad | |
| 4,686,536 | A | 8/1987 | Allcock | |
| 5,200,756 | A * | 4/1993 | Feller | H01Q 1/3275 343/700 MS |
| 5,293,176 | A | 3/1994 | Elliot | |
| 5,418,544 | A | 5/1995 | Elliot | |
| 5,456,433 | A * | 10/1995 | Burns | H01Q 1/1221 248/148 |
| 5,628,057 | A | 5/1997 | Philips et al. | |
| 5,640,168 | A * | 6/1997 | Heger | H01Q 13/02 343/776 |
| 5,796,372 | A | 8/1998 | Elliot | |
| 6,204,825 | B1 | 3/2001 | Wilz | |
| 6,211,751 | B1 | 4/2001 | Aoki | |
| 6,329,649 | B1 | 12/2001 | Jack et al. | |
| 6,359,596 | B1 | 3/2002 | Claiborne | |
| 6,480,167 | B2 | 11/2002 | Matthews | |
| 6,611,180 | B1 | 8/2003 | Puzella et al. | |
| 6,624,787 | B2 | 9/2003 | Puzella et al. | |
| 6,731,189 | B2 | 5/2004 | Puzella et al. | |
| 7,348,932 | B1 | 3/2008 | Puzella et al. | |
| 7,372,424 | B2 * | 5/2008 | Mohuchy | H01Q 3/30 343/700 MS |
| 7,671,696 | B1 | 3/2010 | Puzella et al. | |
| 7,859,835 | B2 | 12/2010 | Puzella et al. | |
| 8,279,131 | B2 | 10/2012 | Puzella et al. | |
| 8,299,976 | B2 | 10/2012 | Lenzi et al. | |
| 8,451,165 | B2 | 5/2013 | Puzella et al. | |
| 8,581,801 | B2 | 11/2013 | Puzella et al. | |
| 8,981,869 | B2 | 3/2015 | Puzella et al. | |
| 9,019,166 | B2 | 4/2015 | Puzella et al. | |
| 9,124,361 | B2 | 9/2015 | Puzella et al. | |
| 2005/0104780 | A1 | 5/2005 | Gottwald et al. | |
| 2006/0261177 | A1 * | 11/2006 | Hirata | B82Y 20/00 239/1 |
| 2007/0126651 | A1 | 6/2007 | Snyder et al. | |
| 2007/0188398 | A1 | 8/2007 | Mohuchy et al. | |
| 2009/0096704 | A1 | 4/2009 | Makarov et al. | |
| 2011/0291907 | A1 | 12/2011 | Puzella et al. | |
| 2014/0111373 | A1 | 4/2014 | Puzella et al. | |
| 2014/0218253 | A1 | 8/2014 | Puzella et al. | |
| 2015/0015453 | A1 | 1/2015 | Puzella et al. | |

FOREIGN PATENT DOCUMENTS

| | | | |
|---|---|---|---|
| WO | WO 2010/054227 | A1 | 5/2010 |
| WO | WO 2012/102576 | A2 | 8/2012 |

OTHER PUBLICATIONS

Chen et al.; "Low Uncertainty Broadband EMC Measurement using Calculable Precision Biconical Antennas;" IEEE International Symposium Electromagnetic Capability, vol. 2; Jan. 2000; 6 Pages.

Cohn; A Class of Broadband Three-Port TEM-Mode Hybrids; IEEE Transactions on Microwave Theory and Techniques Society, vol. MIT-16, No. 2; Feb. 1968; 7 Pages.

Dyson; "Balanced Transmission-Line Measurements Using Coaxial Equipment;" IEEE Transactions on Microwave Theory and Techniques; Jan. 1971; 3 Pages.

Dyson; "Measurement of Near Fields of Antennas and Scatterers;" IEEE Transactions on Antennas and Propagation, vol. AP-21, No. 4; Jul. 1973; 15 Pages.

Ellingson et al.; "Comparison of Two Candidate Elements for a 30-90 MHz Radio Telescope Array;" IEEE Antennas and Propagation Society International Symposium, vol. 1A; Jul. 2005; 4 Pages.

Elliot; "Octave Bandwidth Microwave Scanning Array;" 1995 Antenna Applications Symposium; Sep. 1995; 19 Pages.

Elliot et al.; "Octave Bandwidth Printed Circuit Phased Array Element;" IEEE Antennas and Propagation Society International Symposium; Jul. 2006; 4 Pages.

Elsallal; Dissertation entitled High Performance Phased Arrays of Doubly Mirrored Balanced Antipodal Vivaldi Antenna (DmBAVA): Current Development and Future Considerations; 2007 Antenna Applications Symposium; Sep. 18-20, 2007; 12 Pages.

Fitzgerrell; "Standard Linear Antennas, 30 to 1000 MHz;" IEEE Transactions on Antennas and Propagation, vol. AP-34, No. 12; Dec. 1986; 5 Pages.

Gatti et al; "A Circularly Polarized Crossed Drooping Dipole Antenna;" IEEE Antennas and Propagation Society International Symposium, vol. 1; May 1990; 4 Pages.

Gou et al.; "Wideband Dual-Polarized Patch Antenna with Broadband Baluns;" IEEE Transactions on Antennas and Propagation, vol. 55, No. 1; Jan. 2007; 6 Pages.

Hammerstad et al.; "Accurate Models for Microstrip Computer-Aided Design;" IEEE Microwave Theory and Techniques-S International Microwave Symposium Digest; Jan. 1980; 3 Pages.

Hoofar et al.; "Cross-Polarization Level in Radiation from a Microstrip Dipole Antenna;" IEEE Transactions on Antennas and Propagation, vol. 36, No. 9; Sep. 1988; 7 Pages.

Jones et al.; "A Wide-Band Strip-Line Balun;" IRE Transactions Microwave Theory Techniques; Jan. 1959; 7 Pages.

Kerkhoff et al.; "A Wideband Planar Dipole Antenna for Use in the Long Wavelength Demonstrator Array (LWDA);" IEEE Antennas and Propagation Society International Symposium, vol. 1B; Jul. 2005; 4 Pages.

Kirschning et al.; "Accurate Wide-Range Design Equations for the Frequency-Dependent Characteristic of Parallel Coupled Microstrip Lines;" IEEE Transactions on Microwave Theory and Techniques, vol. MIT-32, No. 1; Jan. 1984; 8 Pages.

Kulkarni et al.; "A Circularly Polarized UHF Antenna at 550-700 MHz;" IEEE Antennas and Propagation Society International Symposium, Jun. 9-15, 2007; 4 Pages.

Lee et al.; "A General Design Formula of Multi-Section Power Divider Based on Singly Terminated Filter Design Theory;" IEEE Microwave Theory and Techniques Society International microwave Symposium Digest; Jan. 2001; 4 Pages.

Lee et al.; "A Low-Profile Wide-Band (5:1) Dual-Pol Array;" IEEE Antennas and Wireless Propagation Letters, vol. 2; Jan. 2003; 4 Pages.

Lee et al,; "Performance of a Wideband (3-14 GHz) Dual-Pol Array;" IEEE Antennas and Propagation Society International Symposium, vol. 2; Jun. 2004; 2 Pages.

Makarov et al.; "Analytical Model of the Split-Coaxial Balun and Its Application to a Linearly-Polarized Dipole or a CP Turnstile;" IEEE Transactions on Antennas and Propagation, vol. 55, No. 7; Jul. 2007; 10 Pages.

Makarov et al.; "Scan Impedance for an Infinite Dipole Array: Hansen's Formula Compared with Ansoft HFSS Simulation;" IEEE Antennas and Propagation Magazine, vol. 49, No. 4; Aug. 1007, 14 Pages.

Makarov et al.; "Multipath Rejection by Virtue of a Chile Ring for a Broadband Droopy Turnstile Antenna;" 2007 Antenna Applications Symposium; Sep. 2007; 41 Pages.

McLean; "Balancing Networks for Symmetric Antennas—I: Classification and Fundamental Operation;" IEEE Transactions on Electromagnetic Compatibility, vol. 44, No. 4; Nov. 2002; 12 Pages.

McLean; "Balancing Networks for Symmetric Antennas: Part II—Practical Implementation and Modeling;" IEEE Transactions on Electromagnetic Compatibility, vol. 46, No. 1; Feb. 2004; 9 Pages.

Mohanty et al.; "Characteristics of Printed Antennas and Arrays Covered with a Layer of Printed Strip-Grating for Suppression of Cross-Polarization;" IEEE Antennas and Propagation Society International Symposium, vol. 2; Jul. 1993; 4 Pages.

Oraizi et al.; "Design and Optimization of Broadband Asymmetrical Multisection Wilkinson Power Divider;" IEEE Transactions on Microwave Theory and Techniques, vol. 54, No. 5; May 2006; 12 Pages.

Pickles et al. "Proposed Coincident Phase Center Orthogonal Dipoles;" Antenna Applications Symposium Proceedings; Sep. 2007; 19 Pages.

(56) References Cited

OTHER PUBLICATIONS

Ping et al.; "A Broadband Rolled Edged Cavity Antenna;" IEEE Antennas and Propagation Society International Symposium, vol. 1; Jun. 2004; 4 Pages.
Pozar et al.; "Analysis of an Infinite Array of Rectangular Microstrip Patches with Idealized Probe Feeds;" IEEE Transactions on Antennas and Propagation, vol. AP-32, No. 10; Oct. 1984; 7 Pages.
Suh et al.; "A Novel Low-profile, Dual-polarization, Multi-band Base-station Antenna Element—The Fourpoint Antenna;" IEEE 60$^{th}$ Vehicular Technology Conference, vol. 1; Sep. 2004; 5 Pages.
Suh et al.; "Bandwidth Improvement for Cross-dipole Type Antennas using a Tuning Plate;" IEEE Antennas and Propagation Society International Symposium, vol. 2A; Jul. 2005; 4 Pages.
Suh et al.; "Low-profile, Dual-polarized Broadband Antennas;" IEEE Antennas and Propagation Society International Symposium, vol. 2; Jun. 2003; 4 Pages.
Wan; "Analytically and Accurately Determined Quasi-Static Parameters of Coupled Microstrip Lines;" IEEE Transactions on Microwave Theory and Techniques, vol. 44, No. 1; Jan. 1996; 6 Pages.
Wilkinson; "An N-Way Hybrid Power Divider;" IRE Transactions on Microwave Theory and Techniques, vol. MII-8, No. 1; Jan. 1960; 3 Pages.
Woelders et al.; "Cross-Polarization and Sidelobe Suppression in Dual Linear Polarization Antenna Arrays;" IEEE Transactions on Antennas and Propagation, vol. 45, No. 12; Dec. 1997; 14 Pages.
Zhong et al.; "Corner-Fed Microstrip Antenna Element and Arrays for Dual-Polarization Operation;" IEEE Transactions on Antennas and Propagation, vol. 50, No. 10; Oct. 2002; 8 Pages.
PCT Partial Search Report received with Invitation to Pay Additional Fees dated Aug. 4, 2011 for Appl. No. PCT/US2011/036735; 5 Pages.
PCT International Search Report and Written Opinion dated Oct. 5, 2011 for Appl. No. PCT/US2011/036735; 23 Pages.
PCT International Preliminary Report dated Dec. 13, 2012 for Appl. No. PCT/US2011/036735; 16 Pages.
Preliminary Amendment dated Aug. 17, 2011 for U.S. Appl. No. 12/791,150; 7 Pages.
Restriction Requirement dated Feb. 1, 2013 for U.S. Appl. No. 12/791,150; 5 Pages.
Response to Restriction Requirement dated Feb. 1, 2013 for U.S. Appl. No. 12/791,150; Response filed on Feb. 4, 2013; 1 Page.
Office Action dated Mar. 1, 2013 for U.S. Appl. No. 12/791,150; 14 Pages.
Response to Office Action dated Mar. 1, 2013 for U.S. Appl. No. 12/791,150; Response filed on Mar. 31, 2013; 12 Pages.
Notice of Allowance dated Jul. 9, 2013 for U.S. Appl. No. 12/791,150; 8 Pages.
Amendment Under 37 CFR 1.312 filed on Aug. 22, 2013 for U.S. Appl. No. 12/791,150; 7 Pages.
U.S. Appl. No. 12/791,150; 223 Pages.
PCT Search Report of the ISA for PCT/US2014/044780 dated Oct. 7, 2014.
PCT Written Opinion of the ISA for PCT/US2014/044780 dated Oct. 7, 2014.

* cited by examiner

STACKED BOWTIE RADIATOR WITH INTEGRATED BALUN

CROSS REFERENCE TO RELATED APPLICATIONS

This application is a continuation-in-part application of and claims the benefit of U.S. patent application Ser. No. 12/791,150 filed Jun. 1, 2010, which is incorporated herein by reference in its entirety.

STATEMENT REGARDING FEDERALLY SPONSORED RESEARCH

Not Applicable.

FIELD

This concepts, systems, circuits and techniques described herein relate generally to radio frequency (RF) circuits and more particularly to an RF antenna and integrated balun.

BACKGROUND

As is known in the art, phased array antennas are comprised of a plurality of antenna elements or radiators. As is also known, in the design of such antenna elements, a trade-off must typically be made between an operating frequency bandwidth characteristics and cross-polarization isolation characteristics. For example, with proper design, an array of dipole elements can be provided a relatively high cross-polarization isolation characteristics in all scan planes; however, bandwidth is limited. On the other hand, array antennas provided from notch radiators or Vivaldi radiators (for example) are capable or operating over a relatively wide frequency bandwidth, but have a relatively low cross-polarization isolation characteristic off the principal axes.

Droopy bowtie elements disposed above a ground plane are a well known means for producing nominally circular polarized (CP) reception or transmission radiation patterns at frequencies from VHF to microwave wavelengths. Droopy bowtie elements are often coupled to a balun which is realized in a co-axial configuration involving separate subassemblies for achieving balun matching and arm phasing functions. Such a design typically results in an integrated antenna-balun assembly having good bandwidth but a poor cross-polarization isolation characteristic. Furthermore, such a design is relatively difficult to assemble (high recurring engineering cost) and cannot easily be adapted to different operating frequencies or polarizations (high non-recurring engineering cost).

It would, therefore, be desirable to provide an integrated antenna element and for use in a phased array antenna which has good wideband RF performance, good cross-polarization isolation characteristics, and which reduces both recurring and non-recurring engineering costs.

SUMMARY

In accordance with one aspect of the concepts, systems, circuits and techniques described herein, an antenna element comprises a dielectric substrate having a general pyramidal shape with a feed point provided at the center. The substrate has an inner surface and an outer surface. Four driven conductors are disposed over the inner surface of the substrate, each of the driven conductors has a generally triangular shape with one vertex terminating proximate the feed point. In addition, four passive conductors are disposed over the outer surface of said substrate, each of the passive conductors being opposite to at least one inner conductor. In some aspects, each passive conductors may have a smaller surface area compared to corresponding ones of the driven conductors.

In accordance with another aspect of the invention, the feed point of the antenna element is electrically coupled to a quad-line vertical balun column. The quad-line balun column has a square cross-sectional shape and a central conductive member with first and second opposing ends. The central conductive member includes four (4) dielectric balun slabs, each having a first surface disposed over a conductive surface of the central member and a second opposing conductive surface.

In accordance with another aspect of the invention, the antenna element driven conductors are fed by the balun and the passive conductors are parasitically coupled to the corresponding ones of the driven conductors.

In accordance with another aspect of the invention, an antenna assembly comprises a printed circuit board (PCB), a feed circuit disposed on one surface of the circuit board, an antenna element, and a quad-line balun column electrically coupled to the feed circuit at one end and electrically coupled to the antenna element at an opposite end. The antenna element comprises a dielectric radiator block having a height and a cavity region formed therein with the cavity region having a pair of opposing surfaces and a feed point provide at the center point of the cavity. The antenna element further comprises a conductive layer disposed on each of the surfaces, each conductive layer coupled to the feed point. The quad-line balun column comprises a central member having four conductive surfaces and first and second opposing conductive ends. The balun column further comprises four (4) dielectric balun slabs, each having a first surface disposed over a conductive surface of the central member and a second opposing conductive surface.

In accordance with another aspect of the invention, the antenna assembly feed circuit comprises a ground conductor coupled to each balun central member conductive surface, a first feed conductor coupled to first balun slab feed conductor, a second feed conductor coupled to second balun slab feed conductor, a third feed conductor coupled to third balun slab feed conductor, and a fourth feed conductor coupled to fourth balun slab feed conductor.

In accordance with another aspect of the invention, the antenna assembly further comprises a support structure over which the antenna element is disposed, wherein a first end of the balun is exposed through a first opening in the support structure and a second end of said balun is exposed through a second opening in the support structure.

In accordance with another aspect of the invention, a plurality of antenna assemblies are provided, arranged in a two-dimensional array pattern.

In accordance with another aspect of the invention, a method for assembling an antenna assembly includes coupling a first end of a quad-line vertical balun column to a circuit board and coupling a second end of the balun to an antenna element.

BRIEF DESCRIPTION OF THE DRAWINGS

The foregoing features of the invention, as well as the invention itself may be more fully understood from the following detailed description of the drawings, in which.

Figure 1:
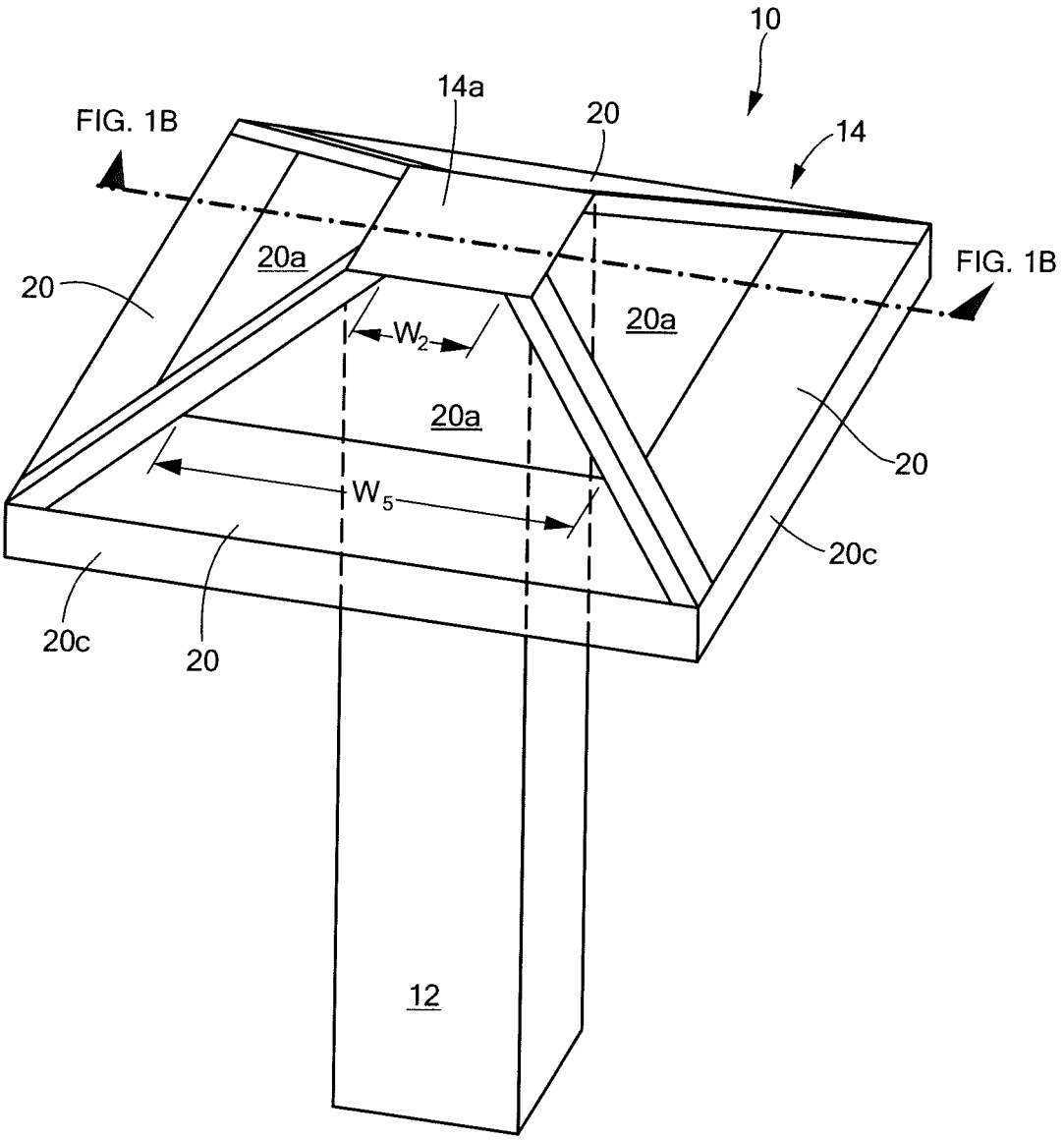
FIG. 1 is a an isometric view of an integrated antenna element having a stacked bowtie antenna element and a quad-line balun column.

It should be understood that in an effort to promote clarity in the drawings and the text, the drawings are not necessarily to scale, emphasis instead is generally placed upon illustrating the principles of the invention.

DESCRIPTION OF THE PREFERRED EMBODIMENTS

Before describing the various embodiments of the circuits, systems and techniques described herein, some introductory concepts and terminology are explained.

Reference is sometimes made herein to a quad-line balun column coupled to an antenna element of a particular type, size and/or shape. For example, one type of antenna element is a so-called stacked bowtie antenna element, a type of turnstile antenna, having a size and shape compatible with operation at a particular frequency (e.g. 10 GHz) or over a particular range of frequencies (e.g. the L, S, C, and/or X-band frequency ranges). Those of ordinary skill in the art will recognize, of course, that other shapes and types of antenna elements (e.g. an antenna element other than a droopy bowtie antenna element) may also be used with a quad line balun column and that the size of one or more antenna elements may be selected for operation at any frequency in the RF frequency range (e.g. any frequency in the range of about 1 GHz to about 100 GHz). The types of radiating elements which may be used with a quad-line balun column (e.g. to form an array) include but are not limited to bowties, notch elements, dipoles, slots or any other antenna element (regardless of whether the element is a printed circuit element) known to those of ordinary skill in the art.

It should also be appreciated that within the embodiments involving an array, the antenna elements in the array can be provided having any one of a plurality of different antenna element lattice arrangements including periodic lattice arrangements (or configurations) such as rectangular, square, triangular (e.g. equilateral or isosceles triangular), and spiral configurations as well as non-periodic or arbitrary lattice arrangements.

Applications in which at least some embodiments of the balun and/or stacked bowtie antenna element described herein may be used include, but are not limited to: radar, electronic warfare (EW) and communication systems for a wide variety of applications including ship based, airborne, missile and satellite applications.

As will also be explained further herein, at least some embodiments of an integrated balun and stacked bowtie antenna element are applicable, but not limited to, military, airborne, shipborne, communications, unmanned aerial vehicles (UAV) and/or commercial wireless applications.

Figure 1A:
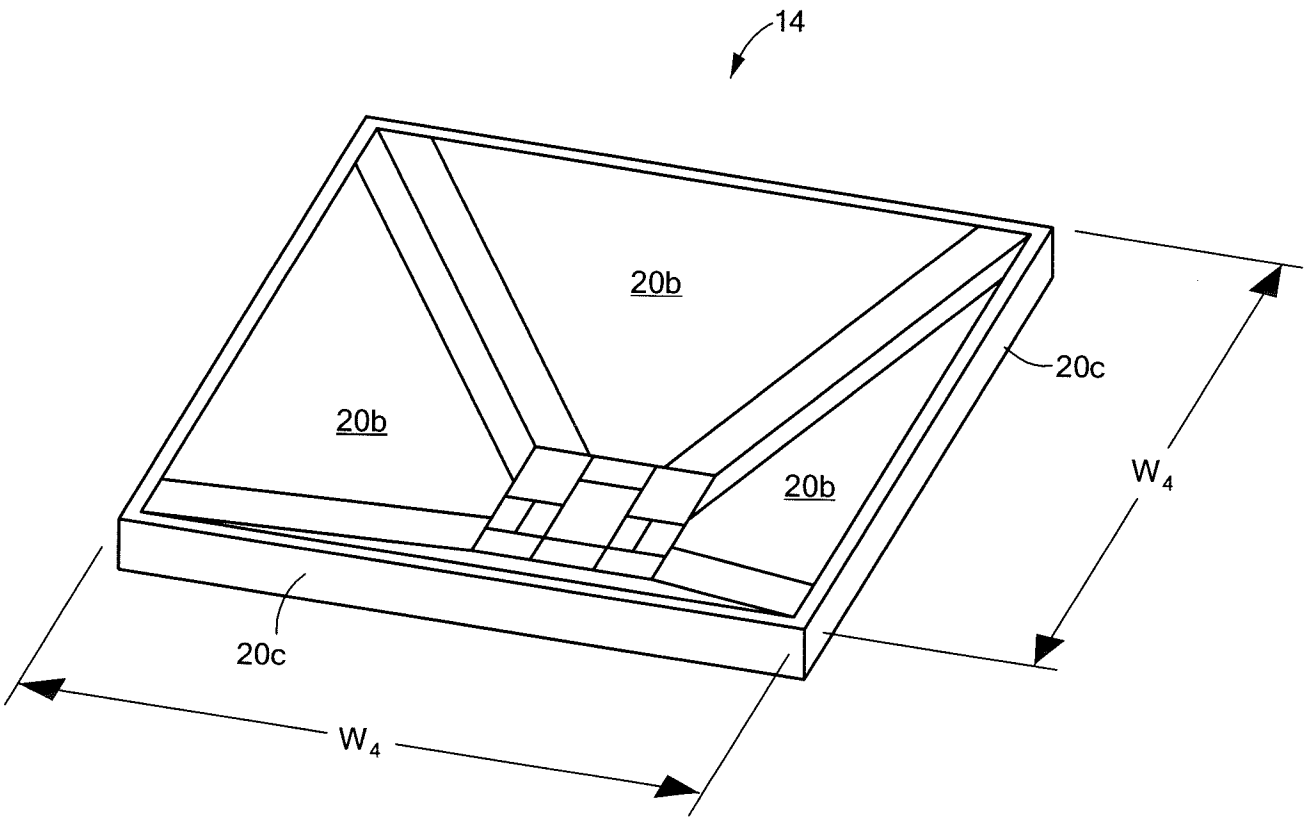
FIG. 1A is an inverted isometric view of the stacked bowtie antenna element of FIG. 1.
Figure 1B:
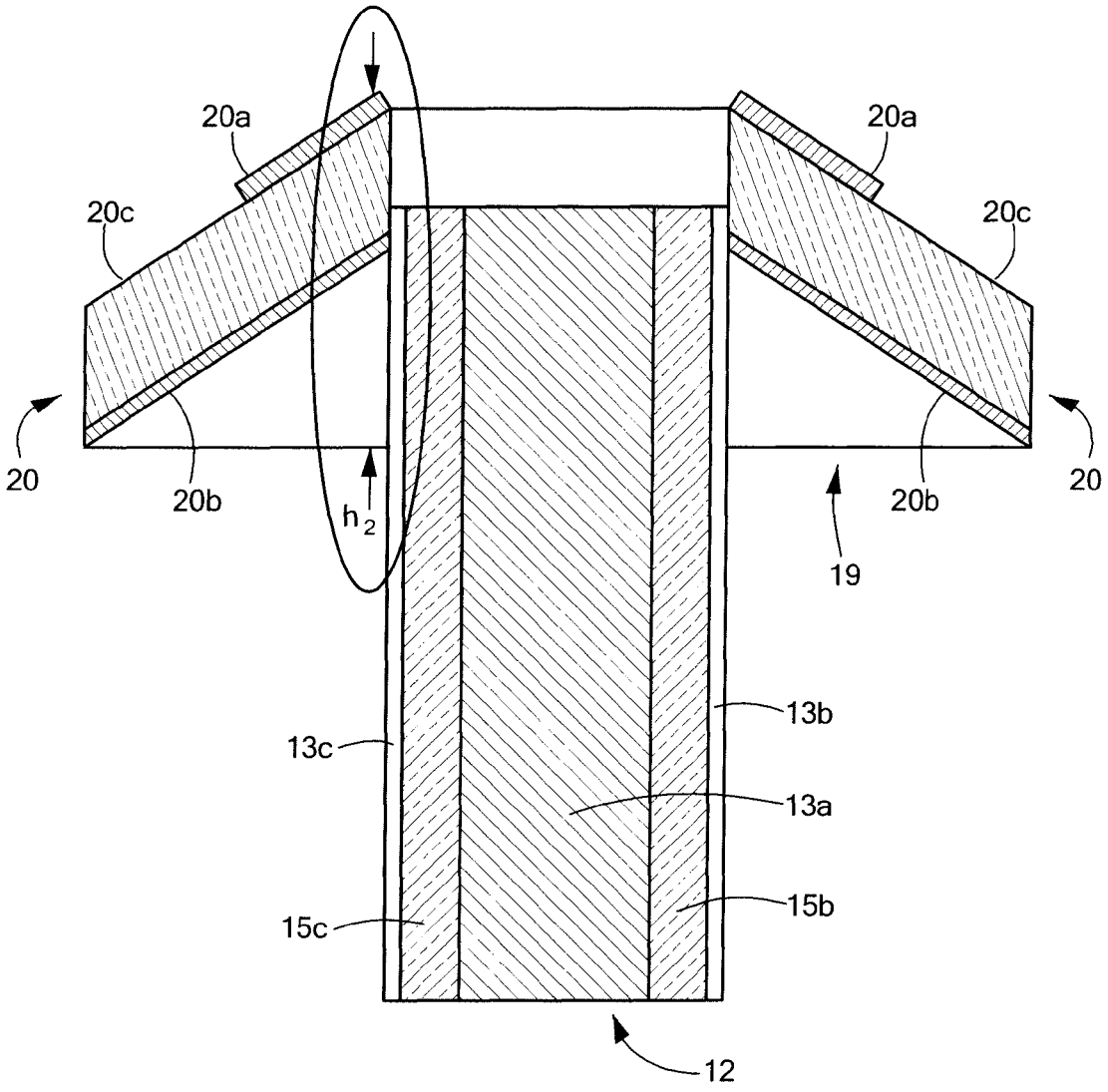
FIG. 1B is a cross-sectional view of the integrated antenna element of FIG. 1.

Referring now to FIGS. 1-1B in which like structures are provided having like reference designations throughout the several views, an integrated antenna element 10 includes a quad-line balun column 12 (or more simply balun 12) having a first end electrically coupled to a feed point of a stacked bowtie antenna element 14 (herein also referred to as antenna element 14). Since balun column 12 is electrically coupled to the center of antenna element 14, the element is also sometimes referred to as a center-fed stacked bowtie antenna element 14.

In some embodiments, the balun column 12 can be mechanically coupled to the antenna element 14 using any technique known in the art including but not limited to soldering, welding, adhering using epoxy, or friction fitting. In preferred embodiments, the antenna element 14 has an opening 14*a* through which balun column 14 can be inserted. As described further below in conjunction with FIGS. 9-9C, this configuration allows the integrated antenna element 14 to be assembled using commercial pick-and-place robots and, therefore, may reduce recurring costs.

The antenna element 14 is a three-dimensional structure which may have a truncated pyramidal shape, as shown in FIGS. 1-1B. In FIG. 1A, the antenna element 14 is shown upside down to reveal a cavity 19 formed by the pyramidal shape. The antenna element 14 includes a plurality, here four (4), stacked bowtie radiators 20, each having a driven conductor 20*b* and a passive conductor 20*a* separated by a dielectric material 20*c*. In preferred embodiments, the antenna element 14 can be a single structure formed by injecting liquid crystal polymer (LCP) into a mold of any suitable shape and size. It will be appreciated that LCP can further serve as the dielectric 20*c*. In another embodiment, each stacked bowtie radiator 20 is manufactured separately and later secured together (e.g. by epoxy) to form the antenna element 14. Thus, the dielectric 20*c* may be either a single piece of dielectric or four separate pieces of dielectric. In some embodiments, slots may be provided between adjacent stacked bowtie radiators 20 to improve isolation and reduce LPC usage/cost. In a preferred embodiment, such slots have a length of about 180 mils.

The driven conductors 20*b* may be provided as four surface-plated metal wings within pyramidal shaped cavity 19 of antenna element 14. The metal wings can be formed through any subtractive or additive process known to those of ordinary skill in the art. The passive conductors 20*a* may also be provided as four surface-plated metal wings disposed opposite each driven conductor 20*b*. For reasons that will be discussed below, each driven conductor 20*b* may have a larger surface area than each corresponding passive conductor 20*a*. In a preferred embodiment, the antenna element 14 is copper platted and copper is selectively removed/etched using a laser to form conductive surfaces 20*a* and 20*b*.

In preferred embodiments, the antenna element 14 has a width/length $w_4$ (shown in FIG. 1A) of about 380 mils and a height $h_1$ (shown in FIG. 1B) of about 140 mils, and the passive conductors 21 have a long edge width w5 of about 284 mils, a short edge width $w_6$ of about 84 mils, and a tapered edge length of about 147 mils (shown in FIG. 1).

Referring now to FIG. 1B, one end of balun column 12 is electrically coupled to the driven conductors 20*b* (only two driven conductors 20*b* are visible in FIG. 1B). In one embodiment, balun column 12 is coupled to the driven conductors 20*b* via a solder connection. Those of ordinary skill in the art will appreciate, of course, that techniques other than soldering may also be used to couple balun column 12 to conductors 20*b*. Such techniques, include but are not limited to welding techniques, and conductive epoxy techniques.

Still referring to FIG. 1B, the operation and advantages of the stacked bowtie radiators 20 will now be described. As previously mentioned, driven conductors 20*b* are electrically coupled to balun column 12, which in turn is electrically coupled to a feed circuit (not shown). In contrast, passive conductors 20*a* are not electrically coupled to the feed circuit. Further, each driven conductor 20*b* is arranged opposite and has a smaller surface area than corresponding ones of the passive conductors 20*a*. Therefore, it should be appreciated that the driven conductors 20*b* are driven/fed by the feed circuit that operate over a first frequency band (centered around a first resonant frequency), whereas the passive conductors 20*a* are "parasitic elements" not driven/fed by the feed circuit that operate over a second frequency band (centered around a second resonant frequency). Thus, the stacked bowtie radiators disclosed herein provide increased bandwidth and operating range compared with existing turnstile radiators.

Figure 2:
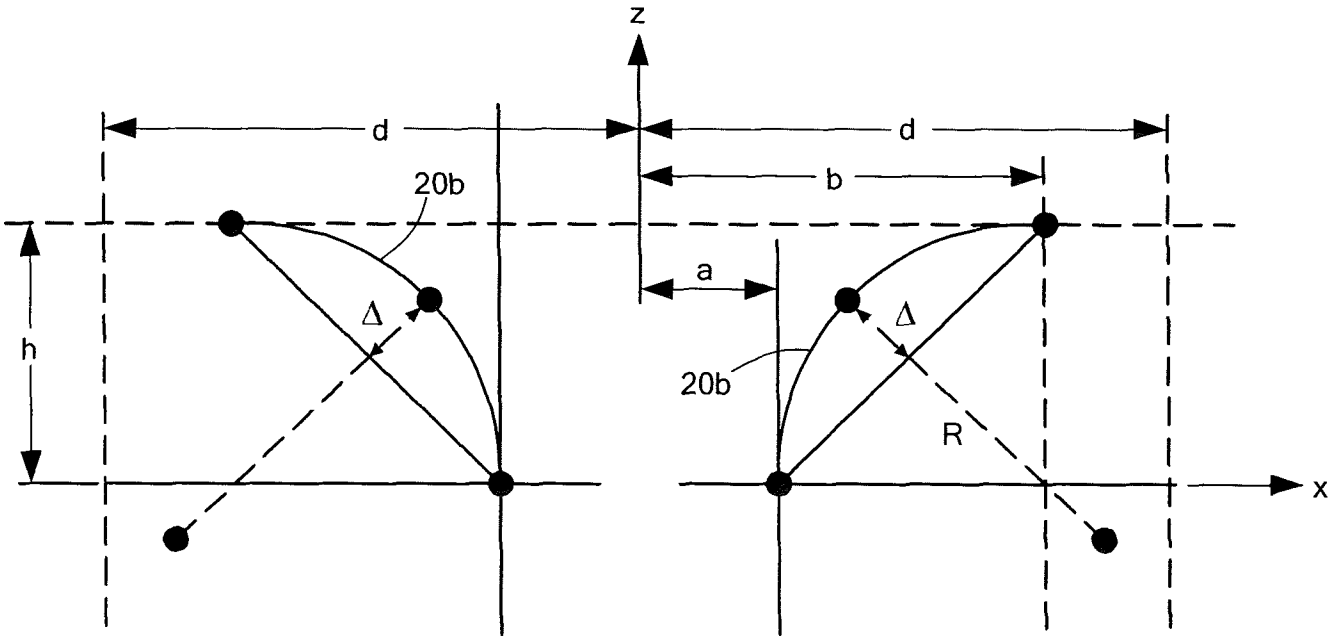
FIG. 2 is a side view of a partial stacked bowtie antenna element.
Figure 3:
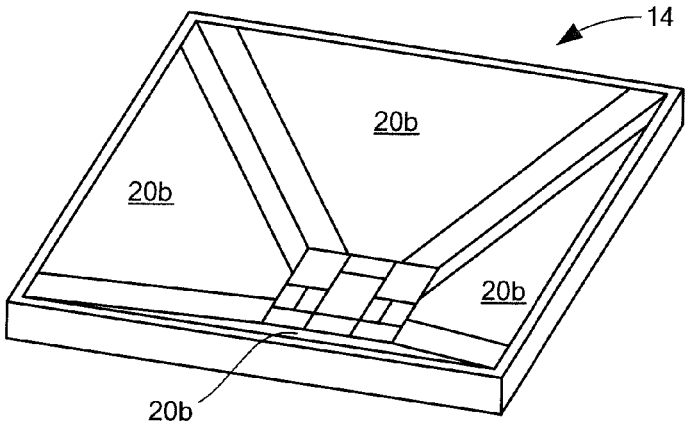
FIGS. 3-3B are perspective views of stacked bowtie antenna elements.

As shown in FIG. 1B, each stacked bowtie radiator 20 may have a generally straight shape. In other embodiments, each radiator 20 may have a convex shape or a concave (negative convex) shape. As illustrated in FIGS. 2 and 3, a convexity factor, Δ, controls the shape of the driven conductors 20*b*. It should be appreciated that the shape of dielectrics 20*c* and passive conductors 20*a* can be adapted to generally match the shape of the driven conductors 20*b*. Thus, changing the convexity factor changes the radiator shape from a convex shape, to a straight shape, to a concave shape. The convexity factor may typically vary from about 0.2 mm to about −0.2 mm for operation in the X-band frequency range. Such a variation usually has a minor effect on the antenna impedance characteristics but, at the same time, it provides acceptable mechanical tolerances to be established for antenna manufacturing. Convexity also provides another design parameter that can be used to optimize element pattern performance with respect to bandwidth. It should, however, be appreciated that regardless of the convexity factor setting, stacked bowtie performance can be toleranced to variations in this factor which make it amenable to established manufacturing processes.

Referring now to FIG. 2 in which like structures are provided having like reference designations as in FIGS. 1-1B, a convexity factor (Δ) controls the shape of the driven conductors 20*b*. As shown in FIGS. 1-1B, the stacked bow-tie radiators 20 may have a generally straight shape. In other embodiments, the radiators 20 may have a convex shape or a concave (negative convex) shape. It will be appreciated that the shape of dielectrics 20*c* and passive conductors 20*a* can be adapted to generally match the shape of the driven conductors 20*b*. Thus, changing the convexity factor changes the radiator shape from a convex shape, to a straight shape, to a concave shape.

The convexity factor may typically vary from about 0.2 mm to about −0.2 mm for operation in the X-band frequency range. Such a variation usually has a minor effect on the antenna impedance characteristics but, at the same time, it provides acceptable mechanical tolerances to be established for antenna manufacturing. Convexity also provides another design parameter that can be used to optimize element pattern performance with respect to bandwidth. It should, however, be appreciated that regardless of the convexity factor setting, stacked bowtie performance can be toleranced to variations in this factor which make it amenable to established manufacturing processes.

Figure 3A:
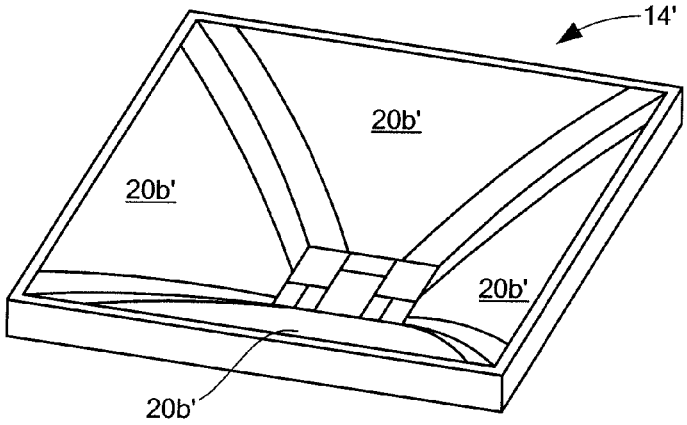
Figure 3B:
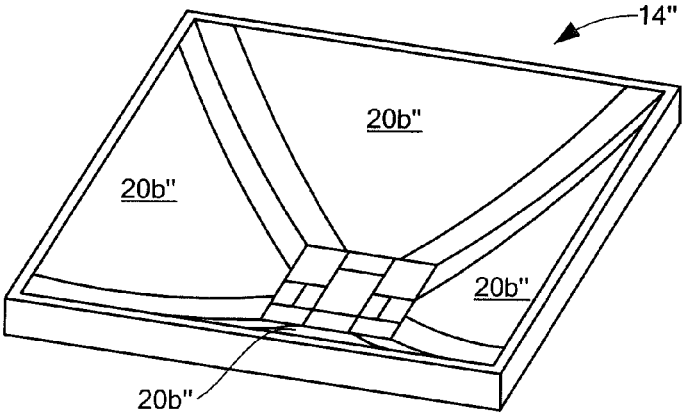

Referring now to FIGS. 3-3B in which like structures of FIGS. 1-1B and 2 are provided having like reference designations, an antenna element 14 (FIG. 3) has a convexity factor (Δ) set equal to zero. Thus, the element 14 and corresponding driven conductors 20*b*, dielectric 20*c*, and passive conductors (not shown) are said to be straight or non-convex. An antenna element 14' in FIG. 3A is provided having a convexity factor (Δ) set equal to 0.06. Thus, element 14' and corresponding driven conductors 20*b*', dielectric 20*c*', and passive conductors (not shown) have a positive convexity and are said to be convex. In FIG. 3B, an antenna element 14" is provided having a convexity factor (Δ) set equal to −0.06. Thus, element 14" and corresponding driven conductors 20*b*", dielectric 20*c*", and passive conductors (not shown) have a negative convexity and are thus said to be concave.

Figure 4:
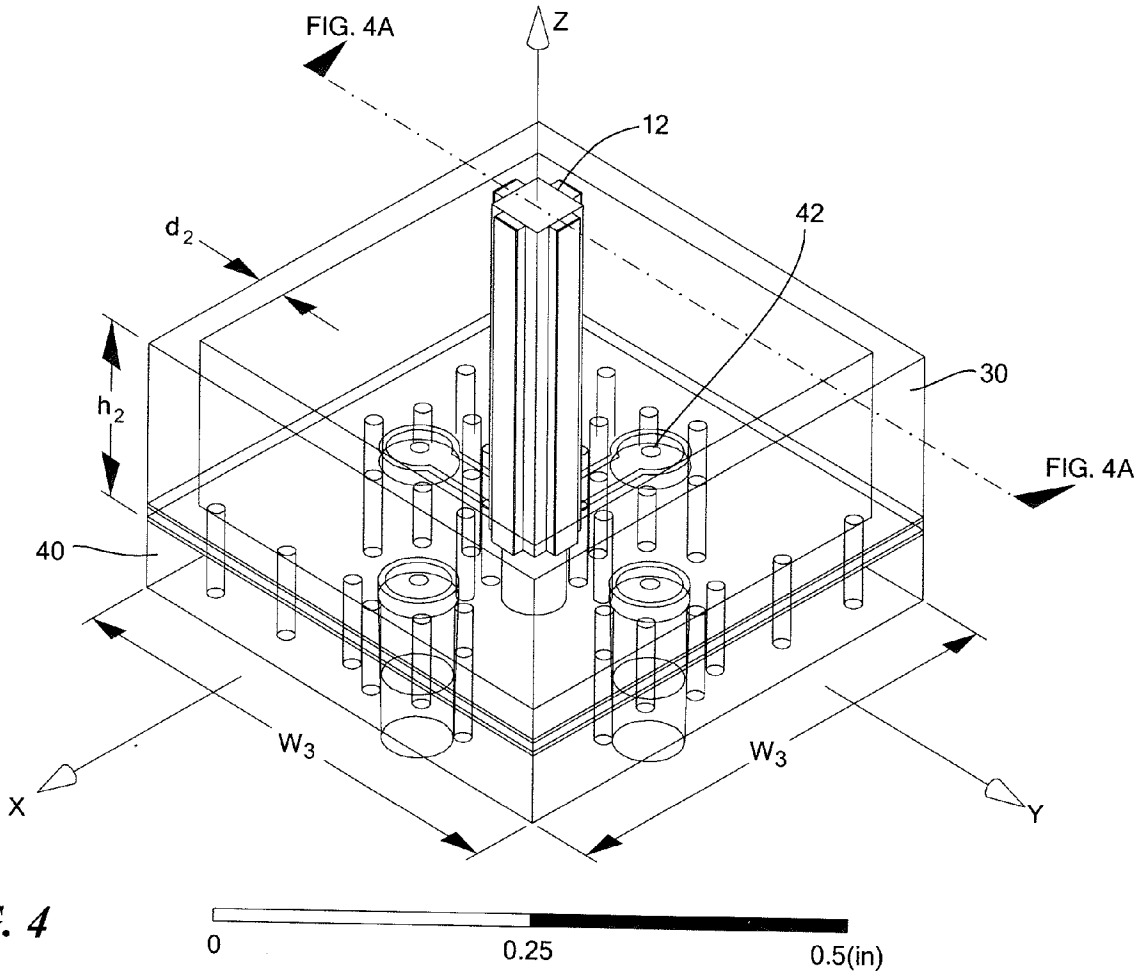
FIG. 4 is an isometric view of a partial unit-cell assembly having a quad-line balun, a feed circuit, and a support structure.
Figure 4A:
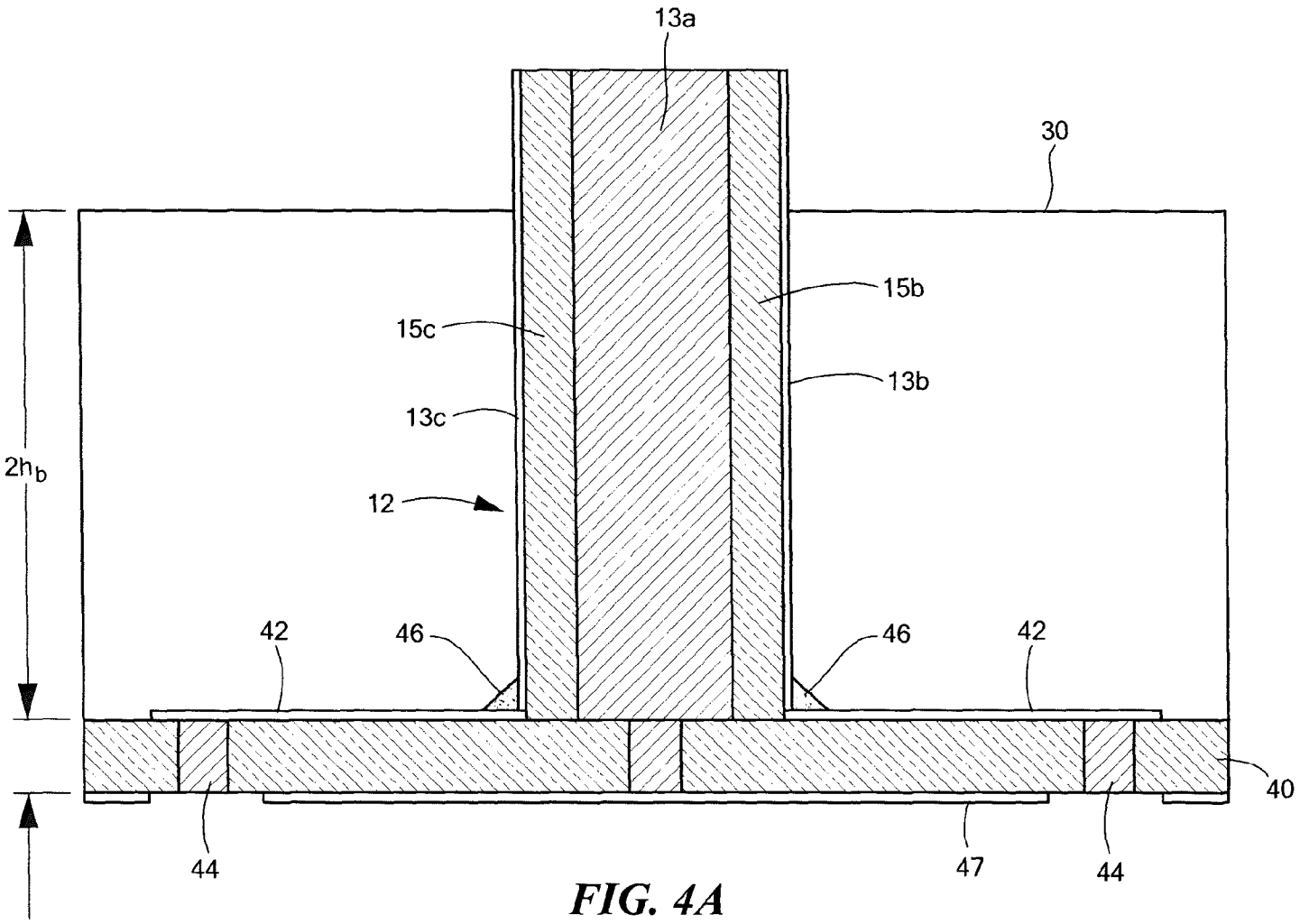
FIG. 4A is a cross-sectional view of the partial unit-cell assembly of FIG. 4.

Referring now to FIGS. 4 and 4A in which like structures of FIGS. 1-1B are provided having like reference designations, a support structure 30 is disposed over a printed circuit board (PCB) 40. A feed circuit 42 is disposed (e.g. printed) onto a surface of the PCB 40, as shown. A quad-line balun column 12 has a first end electrically coupled to feed circuit 42 and mechanically coupled to PCB 40. Feed circuit 42, in turn, may be coupled to other RF circuits (not shown on FIG. 4A), here through via holes 44 for example. In some embodiments, balun column 12 may be electrically coupled to feed circuit 42 via solder connections 46. The solder connections 46 could, of course, also provide mechanical coupling. In a preferred embodiment, the first end of the balun column includes a post, such as post 72 in FIG. 5, which may fit inside a post receptor, such as receptor 48 in FIG. 6 to secure the balun column to the PCB. The feed circuit 42 is discussed more fully below in conjunction with FIGS. 6 and 6A.

The balun column 12 further has a second end which may be exposed through, and extend past, an opening in the support structure 30, as shown. It should be appreciated that the second end of balun column 12 can be electrically and mechanically coupled to an antenna element, such as antenna element 14, as shown in FIGS. 1-1B.

For ease of reference, the combination of a support structure, a feed circuit, a balun column, and a stacked bowtie antenna (not shown in FIG. 4) may hereinafter be referred to as a "unit cell."

In some embodiments, the support structure 30 or portions thereof is/are fabricated using injection molding techniques. However, it should be appreciated that other techniques known in the art may be used to fabricate the support structure 30. In one embodiment, the support structure 30 has conductive surfaces (e.g. metallized walls), thereby providing electrical isolation and suppress surface wave mode coupling between adjacent unit cells within an array antenna (such as the array shown in FIG. 9B). In preferred embodiments, the support structure 30 has a height $h_2$ of 160 mils., a thickness $d_2$ of 30 mils., and a width/length $w_3$ of 440 mils.

Column 12 includes a plurality of here four (4), dielectric substrates 15*a*-15*d* (only dielectric substrates 15*b* and 15*c* being visible in FIG. 4A) with each substrate 15*a*-15*d* having conductors 13*a*-13*d* (only conductors 13*a*-13*c* visible in FIG. 4A) disposed thereon with each of the conductors 13*a*-13*d* having a first end coupled to a corresponding one of four radiators 20 and a second end coupled to a conductor 42 on PCB 40. In one particular embodiment, conductors 13*a*-13*d* are provided having a width equal to the width of the respective substrates 15*a*-15*d* on which they are disposed. In other embodiments, the width of conductors 13*a*-13*d* is less than the width of the respective substrates. In general, the width of conductors 13*a*-13*d* are selected to provide desired impedance and isolation characteristics.

Figure 5A:
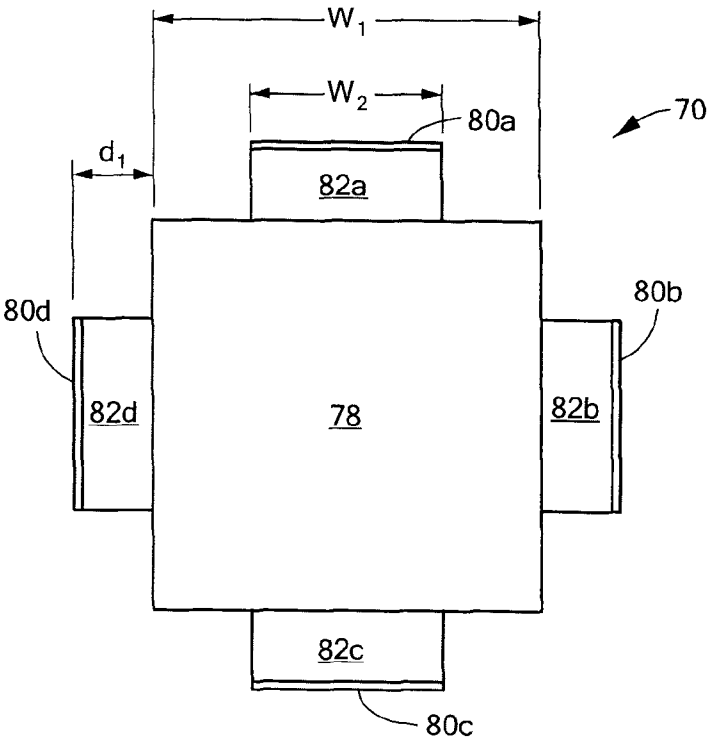
FIG. 5A is a top view of the quad-line balun of FIG. 5.
Figure 5:
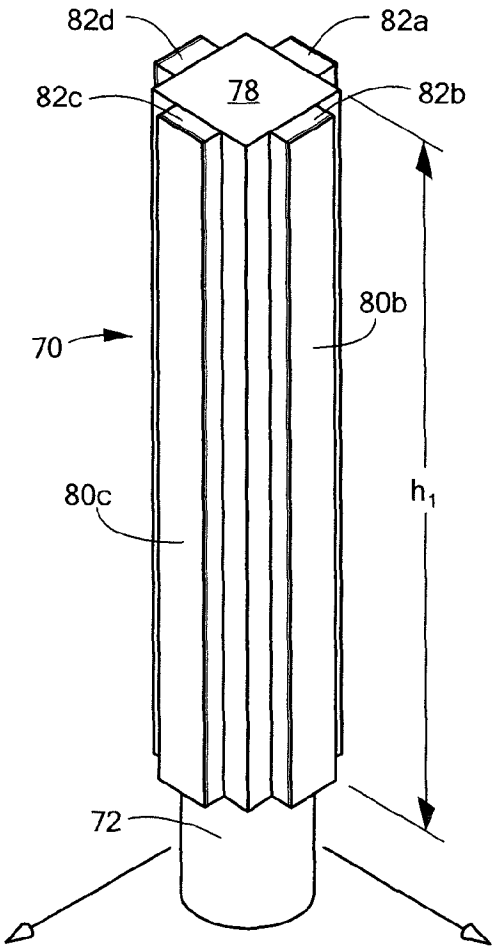
FIG. 5 is an isometric view of a quad-line balun.

Referring now to FIGS. 5 and 5A a vertical rectangular transmission line, known as a quad-line balun column 70, is shown. The balun column 70 includes a central conductive member 78 having a square cross-sectional shape. Dielectric substrates 82*a*-82*d* are disposed over external surfaces of the central member 78. In some embodiments, dielectric substrates 82*a*-82*d* are composed of Rogers RT/duroid 6010 PTFE dielectric material. Dielectric substrates 82*a*-82*d* may be secured to central member 78 using solder, glue, epoxy, welding or any other fastening technique well-known to those of ordinary skill in the art.

In the embodiment shown in FIG. 5A, dielectric substrates 82*a*-82*d* are each provided having conductive material 80*a*-80*d* (conductors 80*a* and 80*d* not visible in FIG. 5) disposed on one surface, but not on the opposing surface. This is because the central member 78 is provided as an opposing conductor. Thus, the dielectric substrates 82*a*-82*d* and respective conductive surfaces 80*a*-80*b* form four adjacent coplanar microstrip transmission lines sharing the same ground provided by the central conductive member 78 (i.e. each disposed on side surfaces of the central conductive member). In other embodiments, it may be desirable or necessary to provide a central member that is not conductive and instead provide separate conductors on the opposing surface of dielectric substrates 82*a*-82*d*. It should be appreciated that balun column 70 is the same or similar to balun column 12 in FIGS. 1-1B, 4, and 4A, in which case conductors 80*a*-80*d* may correspond to conductors 13*a*-13*d* respectively.

In one embodiment, the central conductive member 78 is provided having a square or rectangular cross-sectional shape and is provided as a solid metal conductor (e.g. a copper or brass bar). In other embodiments, the central conductive member need not be solid (e.g. it could be hollow or partially hollow). Also, the central conductive member 78 may be provided from a nonconductive material and have a conductive coating or a conductive surface disposed thereover to provide a central conductive member 78. In one embodiment, the central conductive 78 member is provided from a machining technique. In other embodiments, the conductive member 78 may be formed via a molding technique (e.g. injection molding). Other techniques known to those of ordinary skill in the art may also be used to provide a central conductive member.

In the embodiment of FIG. 5A, conductors 80*a*-80*d* have a width substantially equal to the width of the respective dielectric substrates 82*a*-82*d* on which the conductors 80*a*-80*d* are disposed. In other embodiments, each conductor 80*a*-80*d* may have a width which is less than the width of the respective dielectric substrates 82*a*-82*d* on which it is disposed.

A mounting post 72 may be provided upon the column 70 for mechanically coupling to a PCB. In some embodiments, the mounting post 72 is made of a conductive material and therefore also provides electrical coupling to central conductive member 78 and a feed circuit, such as feed circuit 42 shown in FIG. 6. Of course the mounting post 72 could be made of non-conductive material and a separate means for electrically coupling the central conductive member 78 to a feed circuit may be provided.

Those of ordinary skill in the art will appreciate that certain dimensions of the balun column 70 may affect its operating performance. In general, each dielectric substrate 82*a*-82*d* has height $h_1$, width $w_2$, and thickness $d_1$, as shown. The central conductive member 78 has a width $w_1$ and generally the same height $h_1$ (not including mounting post 72) as each dielectric substrate 82*a*-82*d*. In some preferred embodiments, $w_1$ is chosen to be 50 mils., $w_2$ is chosen to be 25 mils., $d_1$ is chosen to be 10 mil., and $h_1$ is chosen to be 300 mils. It should be appreciated that, in general, the height $h_1$ should be chosen based on the desired operating frequency range.

In one exemplary embodiment, the quad line balun includes colplanar microstrip transmission lines provided from Rogers RT/duroid 6010 PTFE ceramic laminate having a relative dielectric constant ($\in_r$) in the range of about 10.2 to about 10.9 and a loss tangent of about 0.0023. The laminate is provided having a conductive material disposed on opposing surfaces thereof. The conductive material may be provided as ½ oz. of rolled copper or electrodeposited (ED) copper, for example. The transmission lines are cut, etched or otherwise provided from a dielectric sheet, as double-sided strips, and then coupled to a central conductive member using a soldering technique or other suitable attachment technique. The transmission lines may be soldered to the central conductive member 78.

Such a balun construction results in two coplanar transmission line pairs which are highly isolated (in the electrical sense) and which are appropriate for feeding two antennas. This is due to the bulky central conductor and a high-dielectric constant dielectric material used for line filling; furthermore, the lines are isolated by air gaps. It will further be appreciated that balun column 70 provides a higher isolation between two turnstile antenna elements than prior art baluns or feeds since two pairs of feeding transmission lines are shielded.

As illustrated in FIGS. 5 and 5A, the balun transmission lines may each have a characteristic impedance of about 30 Ohms per port, assuming that opposite are fed out of phase by 180 deg. This means a 60 Ohm impedance per one dipole antenna that is fed with two ports in series, which should provide a good impedance match to a stacked bowtie radiator such as that discussed in conjunction with FIGS. 1-3B above. Moreover, a balun constructed as described is suitable for operation over the L-Band, S-band, C-band, and X-band frequency ranges, without changing balun dimensions (excepting length).

Figure 6:
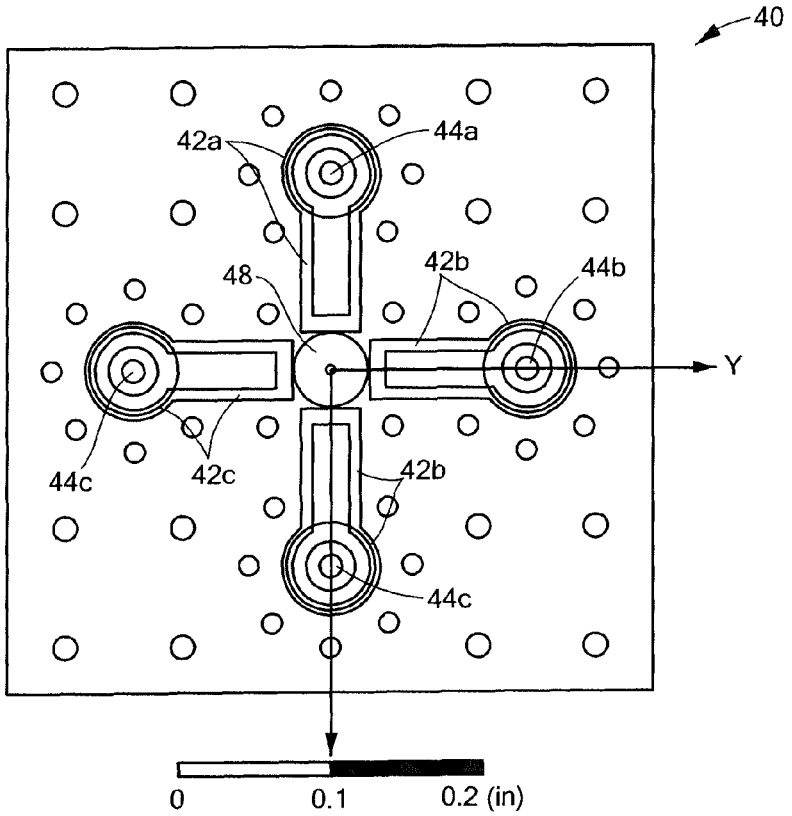
FIG. 6 is a top view of a feed circuit disposed over a printed circuit board (PCB)
Figure 6A:
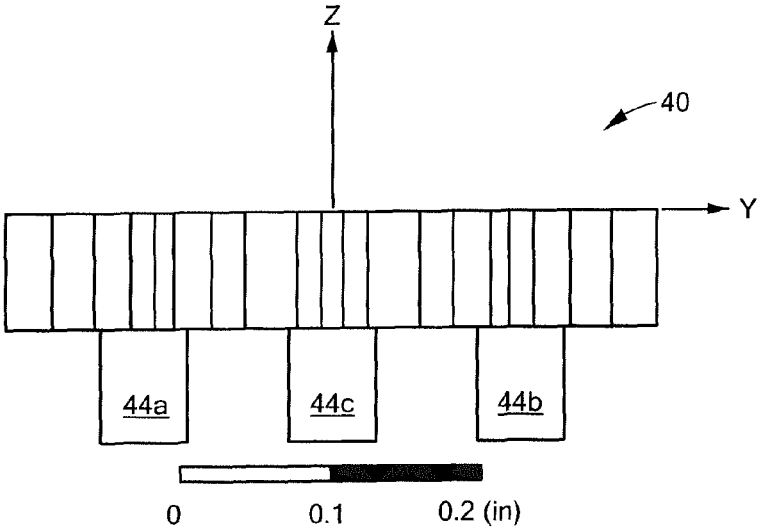
FIG. 6A is a side view of the PCB of FIG. 6.

Referring now to FIGS. 6 and 6A in which like structures of FIGS. 4 and 4A are provided having like reference designations, a feed circuit 42 is disposed (e.g. printed) onto a surface of a PCB 40, as shown. The feed circuit 42 includes four feed lines 42*a*-42*d* which can each be electrically coupled one of four coplanar transmission line conductors provided upon a quad-line balun column, such as conductors 80*a*-80*d* in FIG. 5. The feed circuit 42 also includes a center conductor 48 which can be electrically coupled to a quad-line balun column central conductive member, such as member 78 in FIG. 5. Such electrical couplings can be made, for example, using a solder reflow technique to form a conductive solder joints. The feed lines 42*a*-42*d* and center conductor 48 can be provided upon the PCB using either a subtractive or an additive PCB manufacturing process.

The PCB 40 may provide or be electrically coupled to additional RF circuitry (not shown), such as an RF distribution circuit. The feed lines 42*a*-42*d* may be electrically coupled to the additional RF circuitry via holes 44*a*-44*d* (hole 42*a* not shown in FIG. 6A). It should be appreciated that the holes 44*a*-44*d* may be provided in the PCB 40 via a machining operating (e.g. via a punching technique, a milling technique, or via any other technique known to those of ordinary skill in the art).

In a preferred embodiment, PCB 40 also includes a balun post receptor which accepts a balun column post, such as post 72 in FIG. 5, to secure the balun column to the PCB. For ease of reference, the center connector 48 may herein also be referred to as the balun post receptor 48. The balun post receptor 48 may be a recess which extends entirely through the PCB 40 (e.g. as a through hole) or may extend only partway into the PCB. The balun post receptor 48 may be provided in the PCB 40 by any process known to those of ordinary skill in the art. In a preferred embodiment, the balun column post 72 and post receptor 48 have complimentary cross-sectionals shapes such that the balun column post mates with the receptor, thereby securing the balun 70 (in FIG. 5) to the PCB 40. In some embodiments, the post 72 may be knurled and may be press fit into receptor 48. It should be appreciated that other means, including but not limited to fasteners and brackets, may also be used to secure a balun column to the PCB 40.

Figure 7:
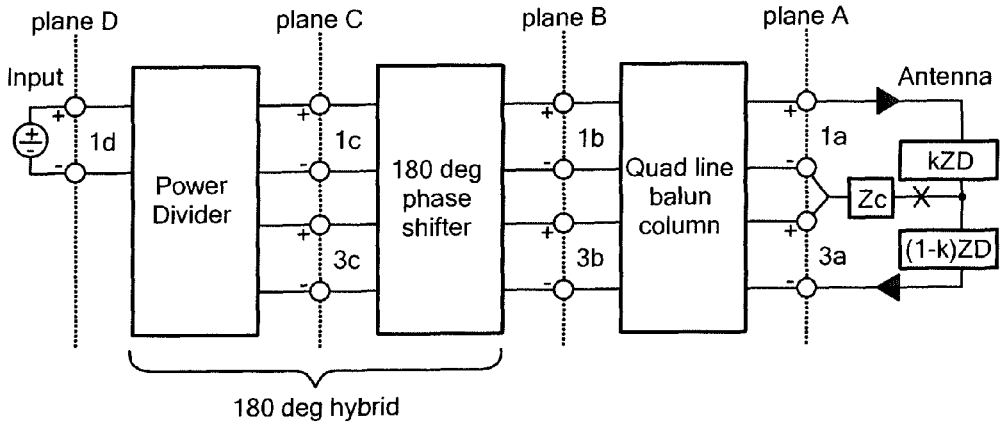
FIG. 7 is a block diagram of an antenna system utilizing a quad-line balun column and a stacked bowtie antenna element.

Referring now to FIG. 7, three reference planes and three separate microwave network elements of the complete quad-line balun-based antenna radiator are shown. The feeding balun for only one antenna element is shown. For a symmetric antenna load with input impedance, $Z_D$, the antenna model in FIG. 7 simplifies as shown in FIG. 8.

Figure 8:
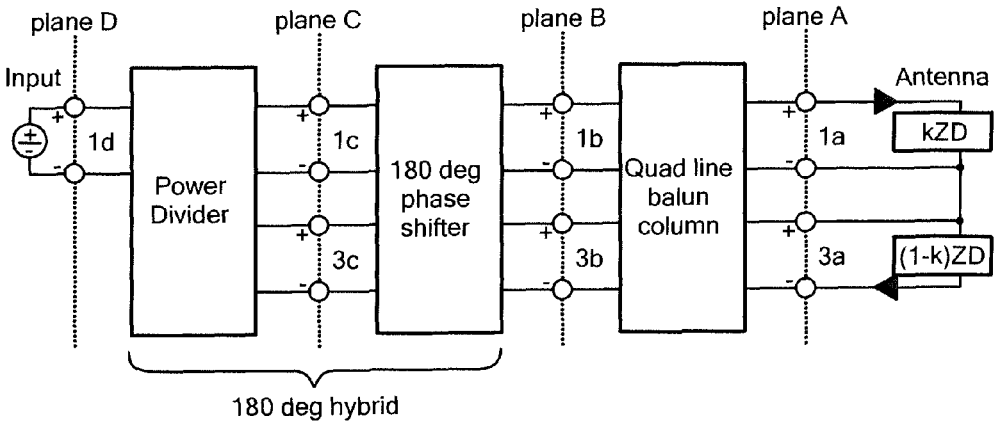
FIG. 8 is a block diagram of an antenna system utilizing a quad-line balun column and a stacked bowtie antenna element.

Referring now to FIG. 8, a block diagram of a complete quad-line balun-based antenna radiator with a symmetric antenna load is shown. It should be noted that to promote clarity in the drawing, the balun for only one antenna element is shown.

It should be noted that using the delay line on one port (e.g. port 1c in FIG. 8) already introduces asymmetry into the setup. Such asymmetry may be taken into account via a power divider model.

The power divider may be provided as either a T-divider or a Wilkinson power divider.

The model of the quad line balun column is that of a transmission line with termination impedance $Z_T=Z_D/2$.

$$Z_{in} = Z_0 \frac{Z_T + jZ_0 \tan\beta L}{Z_0 + jZ_T \tan\beta L} \qquad \text{Equation 1}$$

in which:

L is a length of the quad line balun length;

$Z_0$ is the characteristic impedance of the quad line balun;

$Z_T$ is the termination impedance of the quad line balun;

Similarly, the ratio of input voltage $V_{in}$ to output voltage $V_T$ of the quad line balun, is found from the ABCD matrix of a two-port network, in the form, $$\frac{V_{in}}{V_T} = \cos\beta L + j\frac{Z_0}{Z_T}\sin\beta L \qquad \text{Equation 2}$$

For the phase shifter, a simple λ/2 delay line may be used, whose transmission line model is also given by Equations 1 and 2.

Figure 9:
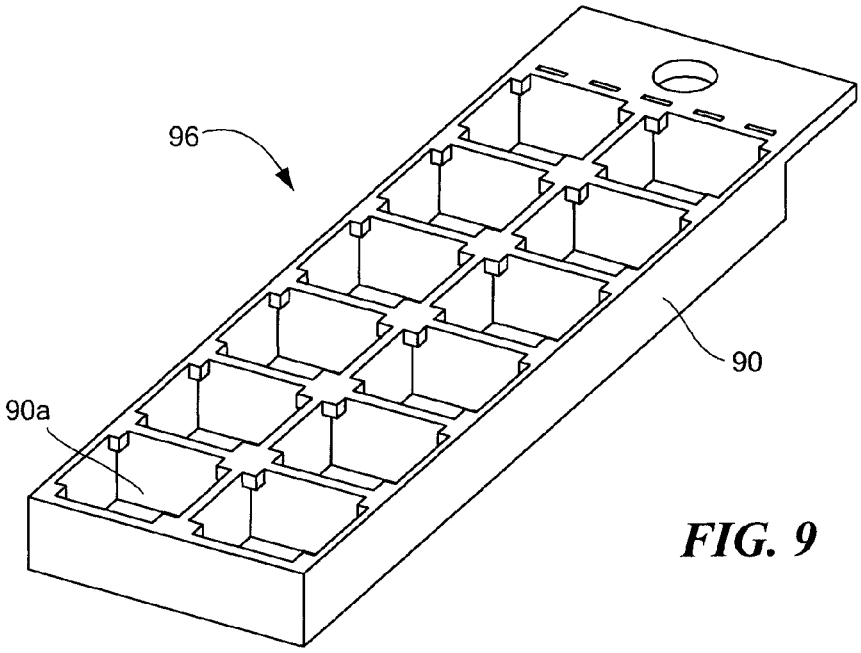
FIG. 9 is an isometric view of an "egg crate" support structure for use in an antenna array assembly.
Figure 9A:
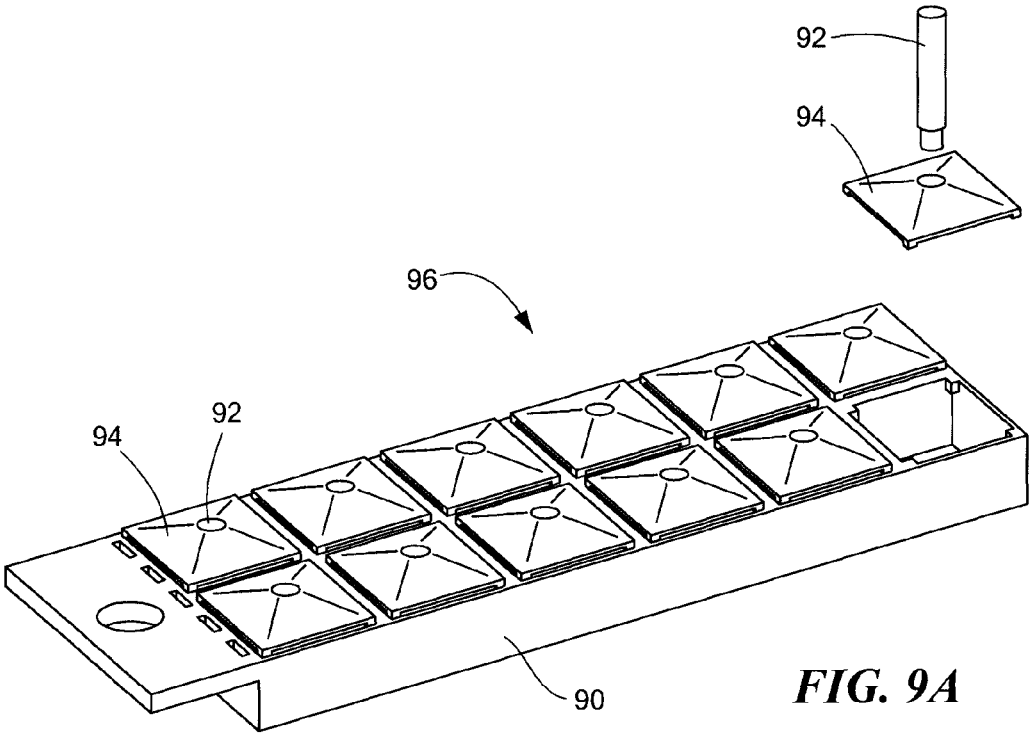
FIGS. 9A and 9B are isometric views of an antenna array assembly.
Figure 9B:
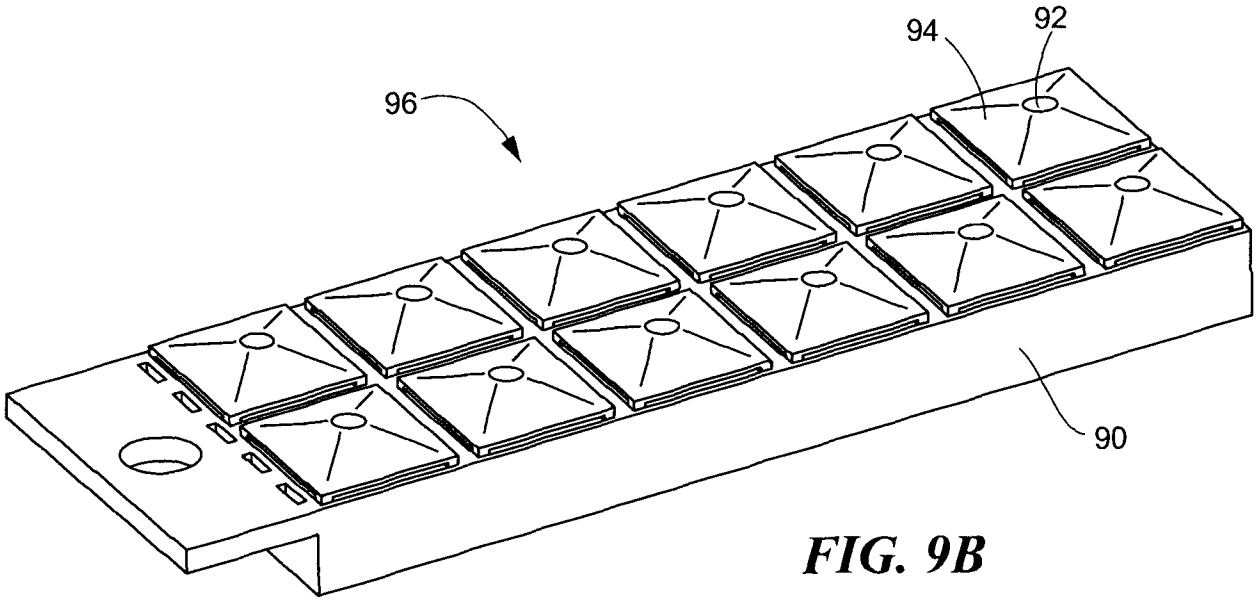
Figure 9C:
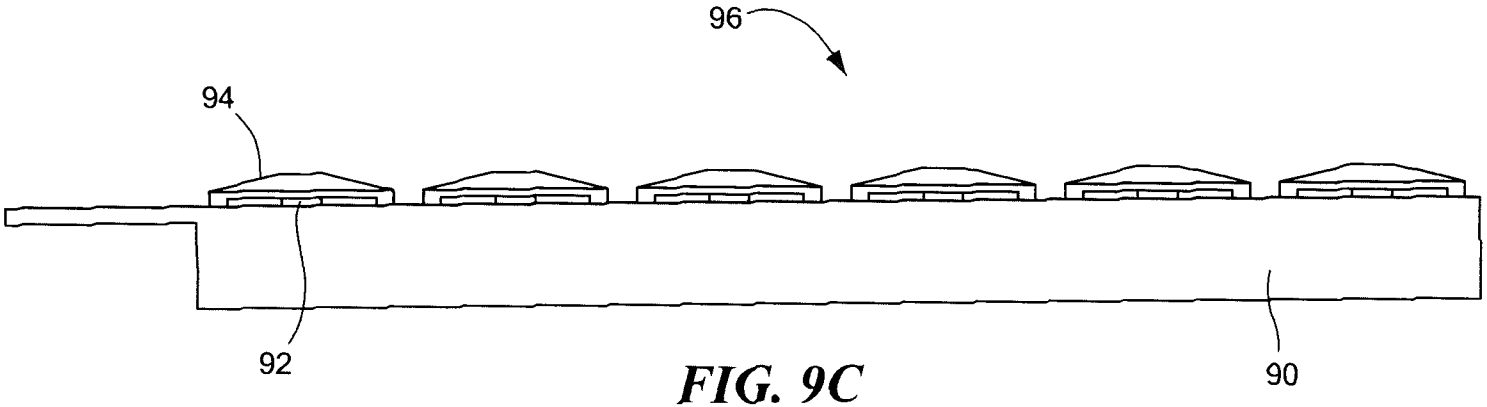
FIG. 9C is a side view of the antenna array assembly in FIGS. 9A and 9B.

Referring now to FIGS. 9-9C in which like structures are provided having like reference designations throughout the several views, an antenna array assembly 96 (also sometimes referred to herein as antenna array 96, array antenna 96, or more simply array 96) is shown in various stages of an assembly process, described hereinbelow.

Referring now to FIGS. 9B and 9C, antenna array 96 comprises a plurality of unit cells, here twelve (12) unit cells arranged in a 2×6 rectangular lattice shape. Each of unit cells may be the same as or similar to the unit cell described above in conjunction with FIG. 4 and includes a balun column 92, a stacked bowtie antenna element 94, and a support structure 90*a*. Each support structure 90*a* includes two openings at opposing ends.

In the preferred embodiment show in FIGS. 9-9C, the plurality of unit cell support structures 90*a* are provided by a single "egg crate" support structure 90. In one embodiment, the egg crate 90 is formed via an injection molding technique, however it should be appreciated that other fabrication techniques can also be used. The egg crate 90 may be bonded to a PCB (not shown in FIGS. 9-9C) having a plurality of feed circuits. The feed circuits may be arranged on the PCB such that, when the egg crate 90 is disposed over the PCB, each feed circuit is exposed through one opening of a corresponding support structure 90*a*.

The array 96 is provided having a length L, a width W and a thickness T. In one particular embodiment, for operation in the X-band frequency range, the array 96 is provided having 8 rows and 16 columns. It should be appreciated that array 96 may be used as a subarray in a larger array structure provided form a plurality of such subarrays 96.

It should further be appreciated that although FIGS. 9-9C illustrate an exemplary array shape and array lattice geometry, array shapes other than rectangular or substantially rectangular shapes could also be used. For example, circular, elliptical or other regular or even non-regular shapes may be used. It should also be appreciated that array geometries other than rectangular or triangular may also be used. It should be noted that although the array is here shown having a square shape and a particular number of antenna elements, an antenna array having any array shape and/or physical size or any number of antenna elements may also be used. The array shape and/or physical size may be determined by a number of factors, including bandwidth requirements, polarization requirements, power requirements, and/or desired scan volume. One of ordinary skill in the art will thus appreciate that the concepts, structures and techniques described herein are applicable to various sizes and shapes of antennas arrays and that any number of antenna elements may be used.

In some embodiments, a radome may be disposed over the array 96 to protect it from weather and/or conceal it from view.

Having described the structure of antenna array 96, an exemplary process of assembling such an array will now be discussed. First, as shown in FIG. 9, the empty egg crate 90 has a plurality of support structures 90*a* and may be bounded to a PCB having a plurality of feed circuits (not shown). Next, as shown in FIG. 9A, a balun column 92 having a post at one end (such as balun column 70 in FIG. 5) is inserted through each support structure 90*a* and into a balun column post receptor provided as part of a corresponding one of the feed circuits. Next, an antenna element 94 having an opening through which the balun column can be inserted (such as antenna element 14 in FIG. 1) is placed over the balun column 92 and brought down to rest upon the support structure 90*a*. Next, solder paste can be applied at each electrical connection, including between the balun column 92 and the feed circuit, and between the balun column 92 and the antenna element 94. Finally, the entire array assembly 96 can be run through a solder re-flow oven to cure the electrical connections. It should be appreciated that array 96 assembly process may proceed in a different order from than described hereinabove. For example, the antenna assembly 94 may be placed upon the support structure 90*a* before the balun column is inserted.

Those having ordinary skill in the art should appreciated that the integrated antenna element design, the scalable phased array antenna architecture, and the assembly techniques describe above allow commercial fabrication and assembly processes to be leveraged, thereby reducing recurring engineering costs. For example, the stacked bowtie antenna element can be fabricated using injection molding and copper plating/etching techniques. The balun column and coplanar transmission lines can be mass produced using a cast and automated soldering techniques. Further, automated assembly techniques, such as commercial pick-and-place robots and solder re-flow lines, may be used to easily and inexpensively assemble unit cells, sub-array assemblies, and entire phased array antennas. Moreover, the design and architectures herein described can easily be adapted to a wide range of frequency bands, including dual-band radars, and are polarization diverse. Thus, the phased array antenna architecture and fabrication technique described herein offers a cost effective solution for design, fabrication, and assembly of phased arrays antennas that can be used in a wide variety of radar missions or communication missions for ground, sea and airborne platforms.

All publications and references cited herein are expressly incorporated herein by reference in their entirety.

In the figures of this application, in some instances, a plurality of elements may be shown as illustrative of a particular element, and a single element may be shown as illustrative of a plurality of a particular elements. Showing a plurality of a particular element is not intended to imply that a system or method implemented in accordance with the concepts, structures and techniques described herein must comprise more than one of that element or step. Nor is it intended by illustrating a single element that the concepts, structures and techniques are/is limited to embodiments having only a single one of that respective element. Those skilled in the art will recognize that the numbers of a particular element shown in a drawing can be, in at least some instances, are selected to accommodate the particular user needs.

It is intended that the particular combinations of elements and features in the above-detailed embodiments be considered exemplary only; the interchanging and substitution of these teachings with other teachings in this and the incorporated-by-reference patents and applications are also expressly contemplated. As those of ordinary skill in the art will recognize, variations, modifications, and other implementations of what is described herein can occur to those of ordinary skill in the art without departing from the spirit and scope of the concepts as described and claimed herein. Thus, the foregoing description is by way of example only and is not intended to be and should not be construed in any way to be limiting.

Further, in describing the concepts, structures and techniques and in illustrating embodiments of the concepts in the figures, specific terminology, numbers, dimensions, materials, etc., are used for the sake of clarity. However the concepts, structures and techniques described herein are not limited to the specific terms, numbers, dimensions, materials, etc. so selected, and each specific term, number, dimension, material, etc., at least includes all technical and functional equivalents that operate in a similar manner to accomplish a similar purpose. Use of a given word, phrase, number, dimension, material, language terminology, product brand, etc. is intended to include all grammatical, literal, scientific, technical, and functional equivalents. The terminology used herein is solely for the purpose of description and should not be construed as limiting the scope of that which is claimed herein.

Having described the preferred embodiments of the concepts sought to be protected, it will now become apparent to one of ordinary skill in the art that other embodiments incorporating the concepts may be used. Moreover, those of ordinary skill in the art will appreciate that the embodiments of the invention described herein can be modified to accommodate and/or comply with changes and improvements in the applicable technology and standards referred to herein. For example, the technology can be implemented in many other, different, forms, and in many different environments, and the technology disclosed herein can be used in combination with other technologies. Variations, modifications, and other implementations of what is described herein can occur to those of ordinary skill in the art without departing from the spirit and the scope of the concepts as described and claimed. It is felt, therefore, that the scope of protection should not be limited to or by the disclosed embodiments, but rather, should be limited only by the spirit and scope of the appended claims.

What is claimed is:

1. An integrated antenna element comprising:

a. an antenna element comprising:

i. a dielectric substrate having a generally pyramidal shape with a feed point provided at the center, the substrate having an inner surface and an outer surface;

ii. at least two inner conductors disposed over the inner surface of the substrate, each of the inner conductors having a generally triangular shape with one vertex terminating proximate the feed point; and iii. at least two outer conductors disposed over the outer surface of said substrate, each of the outer conductors opposite to at least one inner conductor.

2. The integrated antenna element of claim 1 having at least four inner conductors and at least four outer conductors.

3. The integrated antenna element of claim 1 wherein the surface area of the outer conductors is less than the surface area of any corresponding ones of the inner conductors.

4. The integrated antenna element of claim 1 further comprising:

a. a quad-line vertical balun column having an end electrically coupled to the feed point of the antenna element, the quad-line vertical balun column comprising:

i. a central member having four continuously connected conductive surfaces and first and second opposing conductive ends, the central member having a square cross-sectional shape;

ii. a first dielectric balun slab having a first surface disposed over a first conductive surface of the central member and wherein a second opposing surface of the first balun slab has a respective conductor disposed thereon;

iii. a second dielectric balun slab having a first surface disposed over a second conductive surface of the central member and wherein a second opposing surface of the second dielectric slab has a respective conductor disposed thereon;

iv. a third dielectric balun slab having a first surface disposed over a third conductive surface of the central member and wherein a second opposing surface of the balun slab has a respective conductor disposed thereon; and v. a fourth dielectric balun slab having a first surface disposed over a fourth conductive surface of the central member and wherein a second opposing surface of the fourth balun slab has a respective conductor disposed thereon.

5. The integrated antenna element of claim 4 wherein the antenna element has an opening to receive the balun column.

6. The integrated antenna element of claim 4 wherein the inner conductors are fed by the balun and the outer conductors are parasitically coupled to the corresponding ones of the inner conductors.

7. An antenna assembly comprising:

a. a circuit board;

b. a feed circuit disposed on one surface of the circuit board;

c. an antenna element comprising:

i. a dielectric radiator block having a height and a cavity region formed therein with the cavity region having a pair of opposing surfaces and a feed point provide at the center point of the cavity; and ii. a conductive layer disposed on each of the surfaces, each conductive layer coupled to the feed point;

d. a quad-line vertical balun column having a first end electrically coupled to the feed circuit and a second end electrically coupled to the antenna feed point, the quad-line vertical balun column comprising:

i. a central member having four conductive surfaces and first and second opposing conductive ends;

ii. a first dielectric balun slab having a first surface disposed over a first conductive surface of the central member and wherein a second opposing surface of the first balun slab has a respective feed conductor disposed thereon;

iii. a second dielectric balun slab having a first surface disposed over a second conductive surface of the central member and wherein a second opposing surface of the second balun slab has a respective feed conductor disposed thereon;

iv. a third dielectric balun slab having a first surface disposed over a third conductive surface of the central member and wherein a second opposing surface of the third balun slab has a respective feed conductor disposed thereon, and v. a fourth dielectric balun slab having a first surface disposed over a fourth conductive surface of the central member and wherein a second opposing surface of the fourth balun slab has a respective feed conductor disposed thereon.

8. The antenna assembly of claim 7 wherein the dielectric radiator block cavity region has a generally pyramidal shape and each antenna element conductive layer has a generally triangular shape with one vertex terminating proximate the feed point.

9. The antenna assembly of claim 7 wherein each feed circuit comprises:

a. a ground conductor coupled to each balun central member conductive surface;

b. a first feed conductor coupled to first balun slab feed conductor;

c. a second feed conductor coupled to second balun slab feed conductor;

d. a third feed conductor coupled to third balun slab feed conductor; and e. a fourth feed conductor coupled to fourth balun slab feed conductor.

10. The antenna assembly of claim 7 wherein the feed circuit is a first of a plurality of feed circuits, the antenna element is the first of a plurality of antenna elements, and the quad-line vertical balun column is the first of a plurality of quad-line vertical baluns, each of the quad-line vertical baluns are electrically coupled to a corresponding feed circuit at one end and electrically coupled to a corresponding antenna element at the opposite end.

11. The antenna assembly of claim 10 wherein the feed circuits are arranged in a two-dimensional array pattern on the circuit board.

12. The antenna assembly of claim 7 further comprising a support structure over which the antenna element is disposed, wherein a first end of the balun is exposed through a first opening in the support structure and a second end of said balun is exposed through a second opening in the support structure.

13. A method comprising:

a. coupling a first end of a quad-line vertical balun column to a circuit board, and b. coupling a second end of the balun to an antenna element, the antenna element comprising:

i. a dielectric radiator block having a height h and a cavity region formed therein with the cavity region having a generally truncated pyramidal shape with a pair of opposing surfaces and a feed point provided at the center point of the cavity; and ii. a conductive layer disposed on each of the surfaces, each of the conductive layers having a generally triangular shape with one vertices terminating proximate the feed point.

14. The method of claim 13 wherein first end of the balun is coupled to the circuit board before second end of balun is coupled to the antenna element.

15. The method of claim 13 wherein second end of the balun is coupled to the antenna element before first end of balun is coupled to the circuit board.

16. The method of claim 13 wherein the first end of the balun includes a post, the circuit board provides a recess capable of receiving the post, and the first end of the balun is coupled to the circuit board by inserting the post into the recess.

* * * * *